US010249468B2

(12) United States Patent
Kim et al.

(10) Patent No.: US 10,249,468 B2
(45) Date of Patent: Apr. 2, 2019

(54) HIGH-POWERED MAGNETRON

(71) Applicant: KOREA ELECTROTECHNOLOGY RESEARCH INSTITUTE, Changwon (KR)

(72) Inventors: Geun Ju Kim, Ansan (KR); Jung Il Kim, Ansan (KR); In Soo Kim, Seongnam (KR); Jeong Hun Lee, Incheon (KR)

(73) Assignee: KOREA ELECTROTECHNOLOGY RESEARCH INSTITUTE, Changwon (KR)

( * ) Notice: Subject to any disclaimer, the term of this patent is extended or adjusted under 35 U.S.C. 154(b) by 0 days.

(21) Appl. No.: 15/779,491

(22) PCT Filed: Nov. 3, 2016

(86) PCT No.: PCT/KR2016/012571

§ 371 (c)(1),
(2) Date: May 25, 2018

(87) PCT Pub. No.: WO2017/090909

PCT Pub. Date: Jun. 1, 2017

(65) Prior Publication Data

US 2018/0261419 A1 Sep. 13, 2018

(30) Foreign Application Priority Data

Nov. 27, 2015 (KR) ..... 10-2015-0167563

(51) Int. Cl.

| | |
|---|---|
| ***H01J 25/50*** | (2006.01) |
| ***H05H 9/00*** | (2006.01) |
| ***H05H 13/00*** | (2006.01) |

(52) U.S. Cl.

CPC ..... *H01J 25/50* (2013.01); *H05H 9/00* (2013.01); *H05H 13/00* (2013.01)

(58) Field of Classification Search

None

See application file for complete search history.

(56) References Cited

U.S. PATENT DOCUMENTS

| | | | | |
|---|---|---|---|---|
| 5,894,199 | A * | 4/1999 | Pasco | H01J 25/587 315/39.55 |
| 8,111,025 | B2 * | 2/2012 | Whittum | H05H 9/04 315/5.39 |
| 2015/0170866 | A1 * | 6/2015 | Yang | H01J 23/10 219/761 |

FOREIGN PATENT DOCUMENTS

| | | | |
|---|---|---|---|
| JP | 2015-207434 | A | 11/2015 |
| KR | 10-2011-0006237 | A | 1/2011 |
| KR | 10-1297074 | B1 | 8/2013 |
| KR | 10-2015-0053055 | A | 5/2015 |
| KR | 10-2015-0071794 | A | 6/2015 |

OTHER PUBLICATIONS

International Search Report for PCT/KR2016/012571 filed on Nov. 3, 2016.

* cited by examiner

*Primary Examiner* — Dedei K Hammond

(57) ABSTRACT

A high-powered magnetron according to one embodiment of the present invention comprises: a diode including a cathode and an anode; and a tuner unit for varying the electric field in the diode, wherein the tuner unit comprises a plurality of tuners.

6 Claims, 8 Drawing Sheets

CHANGE IN FREQUENCY DEPENDING ON GAP CHANGE IN POWER DEPENDING ON GAP

CHANGE IN FREQUENCY DEPENDING ON GAP

CHANGE IN POWER DEPENDING ON GAP

MAXIMUM POWER DEPENDING ON FREQUENCY

HIGH-POWERED MAGNETRON

CROSS-REFERENCE TO RELATED APPLICATIONS

The present specification is a U.S. National Stage of International Patent Application No. PCT/KR2016/012571 filed Nov. 3, 2016, which claims priority to and the benefit of Korean Patent Application No. 10-2015-0167563 filed in the Korean Intellectual Property Office on Nov. 27, 2015, the entire contents of which are incorporated herein by reference.

TECHNICAL FIELD

The present invention relates to a high-powered magnetron. More particularly, the present invention relates to a high-powered magnetron capable of obtaining a high power by using a plurality of tuner structures.

BACKGROUND ART

A magnetron oscillator is a high-efficiency and high-powered electromagnetic wave generating device that converts electric energy of an electron beam generated in a high vacuum where there is a crossed field where an electric field and a magnetic field are perpendicularly applied to high-powered electromagnetic wave energy and radiates the high-powered electromagnetic wave energy.

The magnetron oscillator was first designed in the 1930s and started to be researched and developed in earnest in the UK and USA for radar applications starting from World War II. Currently, the magnetron oscillator is widely used in industrial, defense, medical, environmental, scientific, and energy fields using characteristics of the magnetron oscillator.

The magnetron oscillator may include a cathode generating the electron beam and a resonator having a constant operating frequency, and an output unit having an antenna structure for radiating the electromagnetic wave generated in the resonator to the outside. More specifically, the electron beam generated in the cathode rotates in each direction according to the Lorentz force by the electric field generated by a voltage applied between the cathode and an anode and the magnetic field applied in an axial direction. In this case, the rotating electron beam resonates at a specific frequency with the resonator and is spatially gathered through the resonance to have an AC component. The electromagnetic wave having an operating frequency is generated in the resonator by the AC component of the electron beam and the generated electromagnetic wave is radiated to the outside through an output section constituted by an antenna. A frequency of the electromagnetic wave generated from the magnetron oscillator can generate the electromagnetic wave from a microwave band to the terahertz wave band according to a condition causing the resonance.

As an example, a high-powered magnetron is used in combination with a linear accelerator (LINAC) to accelerate the electron beam by supplying high output RF in the linear accelerator. As described above, in this case, the resonance frequency of the linear accelerator and the RF of the magnetron to be applied need to be matched in order to accelerate the maximum electron beam in the connected linear accelerator. To this end, in the high-powered magnetron, in most cases, a tuning structure is installed on one side of the high-powered magnetron and the frequency oscillated from the magnetron is adjusted by using a change in electric field depending on a gap distance in the installed tuning structure. In this case, the power increases with the increase of the frequency as a gap increases for frequency variation, but when the gap is out of a predetermined distance, the oscillation becomes unstable rapidly. Therefore, the currently used high-powered magnetron has a limit in the maximum frequency variable width, such as using a frequency variable width within approximately 10 MHz to maintain stable oscillation.

DISCLOSURE

Technical Problem

A high-powered magnetron according to an embodiment of the present invention has been made in an effort to implement a change a wider range of frequency variation by using a change in electric field.

Further, a high-powered magnetron according to an embodiment of the present invention has been made in an effort to obtain higher power in a predetermined frequency band.

The technical objects of the present invention are not limited to the aforementioned technical objects, and other technical objects, which are not mentioned above, will be apparently appreciated by a person having ordinary skill in the art from the following description.

Technical Solution

A high-powered magnetron according to an embodiment of the present invention may include: a diode including a cathode and an anode; and a tuner unit varying an electric field in the diode, in which the tuner unit may include a plurality of tuners.

The tuner unit may include two tuners positioned symmetric to each other with respect to the diode.

The frequency and power of the high-powered magnetron may be determined by a gap between internal structures of the tuner.

The frequency and power of the high-powered magnetron may be determined by adjusting the gap for the other tuner while fixing one tuner gap.

The frequency and power of the high-powered magnetron may be determined by adjusting the gap for both the two tuners.

A particle accelerator according to an embodiment of the present invention may include: a high-powered magnetron; and a particle accelerating unit connected with the high-powered magnetron to accelerate particles using the high-powered magnetron.

Advantageous Effects

A high-powered magnetron according to an embodiment of the present invention can implement a wider range of frequency variation by using a change in electric field.

Further, a high-powered magnetron according to an embodiment of the present invention can obtain higher power in a predetermined frequency band.

The technical effects of the present invention are not limited to the aforementioned technical effects, and other technical effects, which are not mentioned above, will be apparently appreciated by a person having ordinary skill in the art from the following description.

BEST MODE

The present invention, operational advantages of the present invention, and objects achieved by executing the present invention will be, hereinafter, described by exemplifying preferable embodiments of the present invention and referring to the exemplified embodiments.

First, terms used in the present application are just used to describe a specific embodiment and do not intend to limit the present invention and a singular expression may include a plural expression as long as it is not apparently contextually different. Further, in the present application, it should be understood that the term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance. Meanwhile, in describing the present invention, a detailed explanation of related known configurations or functions may be omitted to avoid obscuring the subject matter of the present invention.

A high-powered magnetron according to an embodiment of the present invention starts a change in electric field through a plurality of tuners, in particular, through two symmetric tuners to obtain a variation range of a higher output frequency and higher output power than the related art. In addition, the high-powered magnetron according to an embodiment of the present invention may adjust a magnetron frequency to a frequency of a connected particle accelerator or the like according to tuner distance (distance or gap) adjustment of a plurality of tuners. Such a high-powered magnetron will be described below in detail with reference to the drawings.

Figure 1:
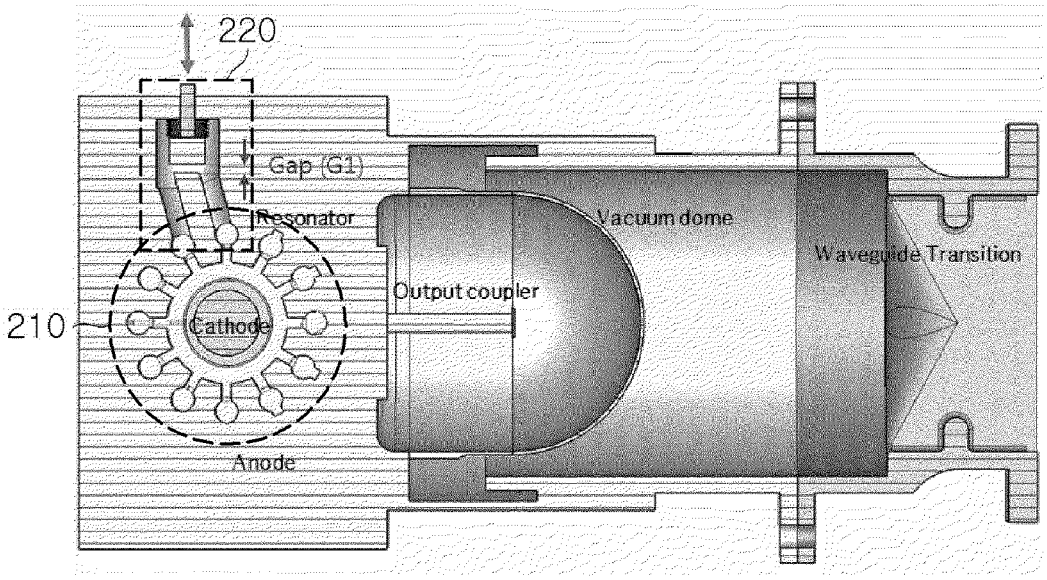
FIG. 1 is a diagram illustrating a tuning structure in a high-powered magnetron in the related art.

FIG. 1 is a diagram illustrating a tuning structure in a high-powered magnetron in the related art. As illustrated in the figure, a tuning structure in a high-powered magnetron in the related art may adjust an internal resonance frequency by adjusting an electric field by using a single tuner and adjusting a gap G1 of a tuner. However, in such a case, there is a problem that a frequency variable range (approximately 10 MHz) is narrow, and accordingly, the power according to frequency variation also becomes unstable.

Figure 2:
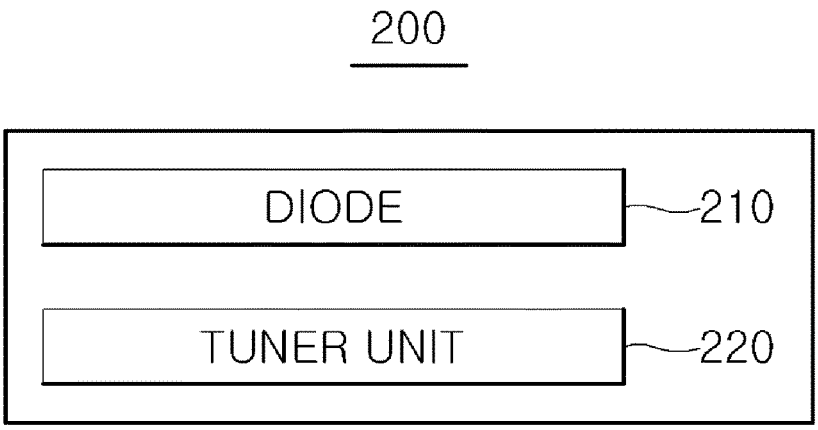
FIG. 2 is a block diagram illustrating a configuration of a high-powered magnetron according to an embodiment of the present invention.

FIG. 2 is a diagram illustrating a configuration of a high-powered magnetron according to an embodiment of the present invention. As illustrated in the figure, a high-powered magnetron 200 according to an embodiment of the present invention may include a diode 210 and a tuner unit 220.

The diode 210 may include a cathode and an anode. Particles may be emitted from the cathode by a voltage applied to the cathode and the anode. The emitted particles are subjected to a circular motion according to the Lorentz force by a magnetic field applied through a magnet unit (not illustrated) or the like in the magnetron and subjected to an acceleration motion by the applied electric field.

The tuner unit 220 may vary the electric field distribution in the diode 210. More specifically, the particles rotating through the diode 210, and the applied magnetic field and electric field resonate at a specific frequency and are spatially aggregated through the resonation to have an AC component. An electromagnetic wave having a predetermined operating frequency is generated by the AC component of the particles and the generated electromagnetic wave may be radiated to the outside through an output unit (not illustrated and constituted by an antenna or the like).

Therefore, in the high-powered magnetron, an operation for equalizing an external connected resonance frequency and a frequency is required and the tuner unit 220 may be used for the operation. As illustrated in FIG. 2, the operation may be performed by using that capacitance of an equivalent circuit varies as a tuner gap (expressed as a gap or distance) of the tuner unit 220 is adjusted. That is, since the resonance frequency is proportional to $$\frac{1}{\sqrt{LC}},$$

it is possible to adjust the resonance frequency by using the capacitance which is changed according to the adjustment of the tuner gap.

In addition, the tuner unit 220 according to an embodiment of the present invention may include a plurality of tuners and changes an electric field inside a resonator including a tuner using the plurality of tuners to vary and change a wider range of frequency. In this regard, it is preferable that the tuner unit 220 positions the two tuners symmetrically in terms of frequency variation and power magnitude.

Further, an output frequency and an output power of the high-powered magnetron may be determined by the gap of the tuner. That is, the resonance frequency may be changed based on the change in capacitance due to the gap adjustment and as illustrated in the figure, when the tuner unit 220 is constituted by two symmetric tuners, the resonance frequency and the output power may be changed by adjusting individual tuner gaps. This will be described below in detail with reference to FIGS. 4, 5, 6, 7A and 7B.

Meanwhile, the tuner unit 220 may be connected to an anode side of the diode 210 to change the electric field.

Figure 3:
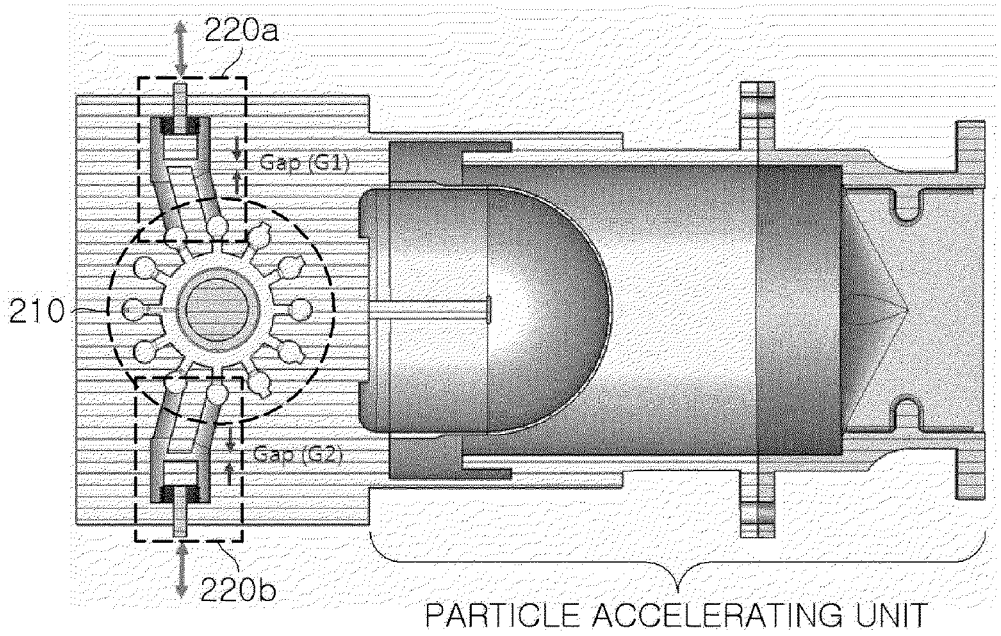
FIG. 3 is a diagram illustrating a high-powered magnetron according to an embodiment of the present invention.

FIG. 3 is a diagram illustrating a high-powered magnetron according to an embodiment of the present invention. As illustrated in the figure, a high-powered according to an embodiment of the present invention may include two tuner structures positioned symmetric to each other.

More specifically, as illustrated in FIG. 3, based on tuner structures 220*a* and 220*b* in which the two tuners are symmetric around the diode, gaps G1 and G2 between internal structures of each tuner are adjusted as illustrated in FIG. 3 to change the resonance frequency and the power of the electric field formed in the diode.

MODE FOR INVENTION

Figure 4:
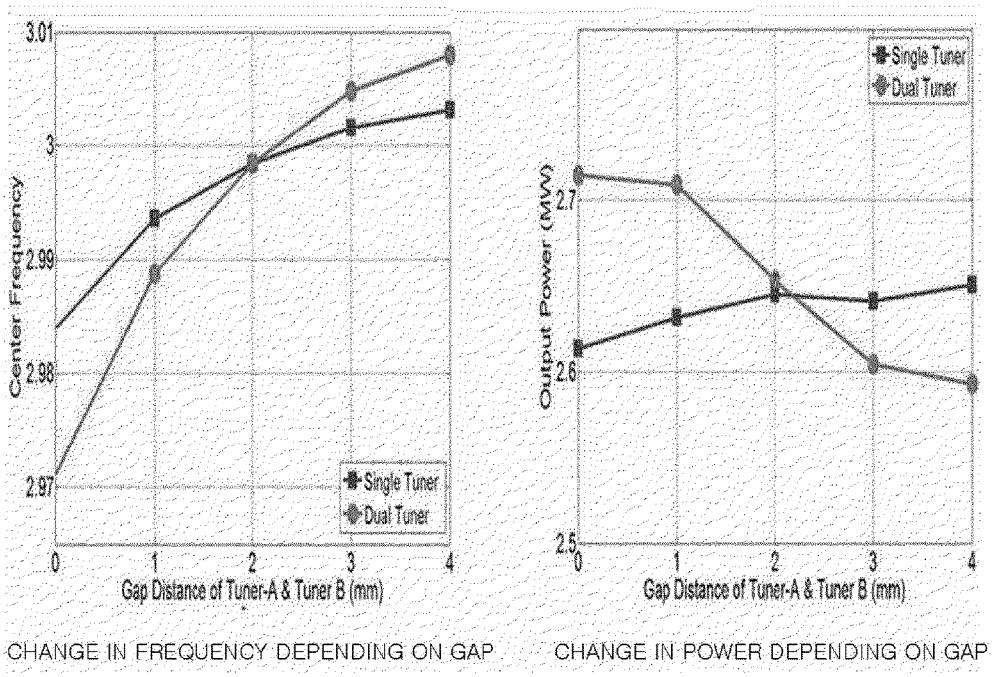
FIG. 4 is a graph illustrating maximum power depending on a frequency when the high-powered magnetron is used according to an embodiment of the present invention.
Figure 5:
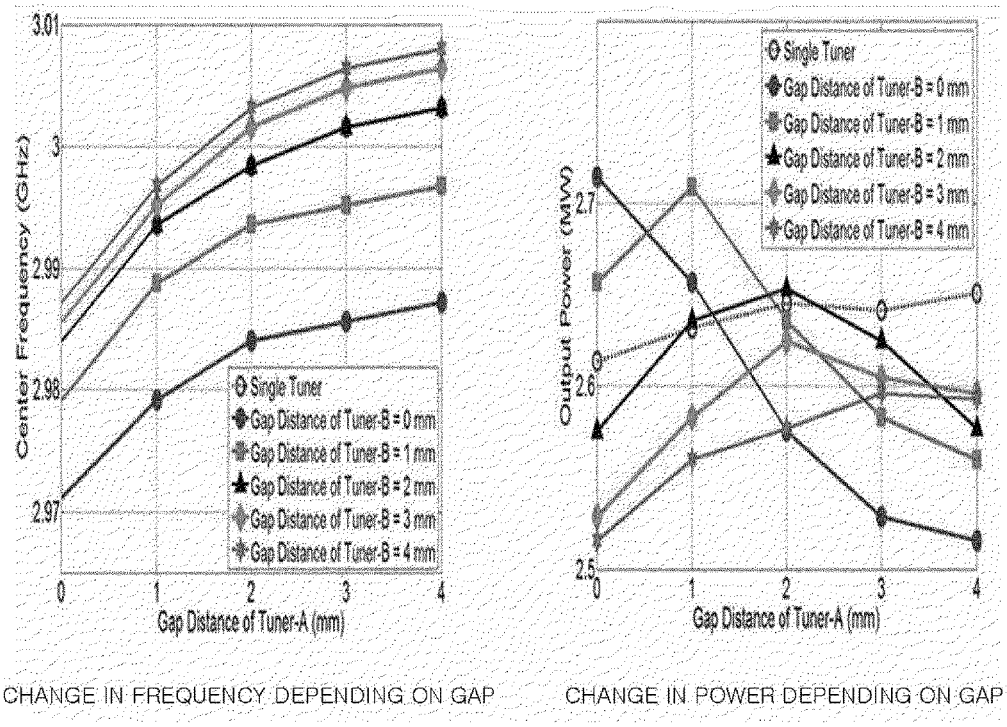
FIG. 5 is a graph illustrating a change in frequency and power depending on adjustment of a tuning distance when a high-powered magnetron is used according to another embodiment of the present invention.
Figure 6:
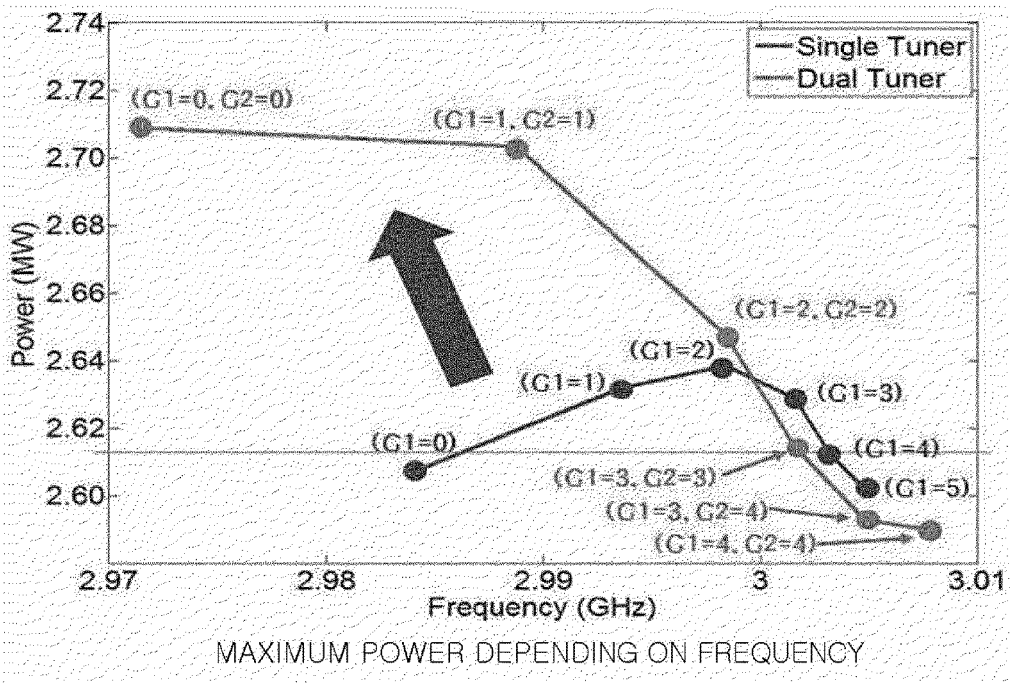
FIG. 6 is a graph illustrating a change in frequency and power depending on adjustment of a tuning distance when a high-powered magnetron is used according to yet another embodiment of the present invention.

FIGS. 4 to 6 below are graphs in which changes in frequency and power depending on the frequency when a high-powered magnetron is used. And, the frequency and power depending on the frequency using an embodiment of the present invention are verified by using CST Studio.

First, FIG. 4 is a graph illustrating a change in frequency and power depending on adjustment of a tuning distance when a high-powered magnetron is used according to an embodiment of the present invention. As illustrated in the figure, when the high-powered magnetron according to an embodiment of the present invention is used, it can be seen that the frequency variation range increases by approximately two times as compared with the tuning structure in the related art and it can be seen that the power is improved only by the tuner without a change in applied electric field and magnetic field.

FIG. 5 is a graph illustrating a change in frequency and power depending on adjustment of a tuning distance when a high-powered magnetron is used according to another embodiment of the present invention. As illustrated in the figure, it can be verified that in the case of using the high-powered magnetron according to another embodiment of the present invention, it is possible to linearly change the frequency through tuner gap distance adjustment and to control the power with the same frequency by adjusting the gap distance.

FIG. 6 is a graph illustrating maximum power depending on a frequency when the high-powered magnetron is used according to yet another embodiment of the present invention. As illustrated in the figure, when the high-powered magnetron according to yet another embodiment of the present invention is used, it can be seen that the output power increases by approximately 0.1 MW in a predetermined frequency range and it can be seen that the power in a low frequency range is also improved. Further, it can be seen that the frequency variation range increases.

Figure 7A:
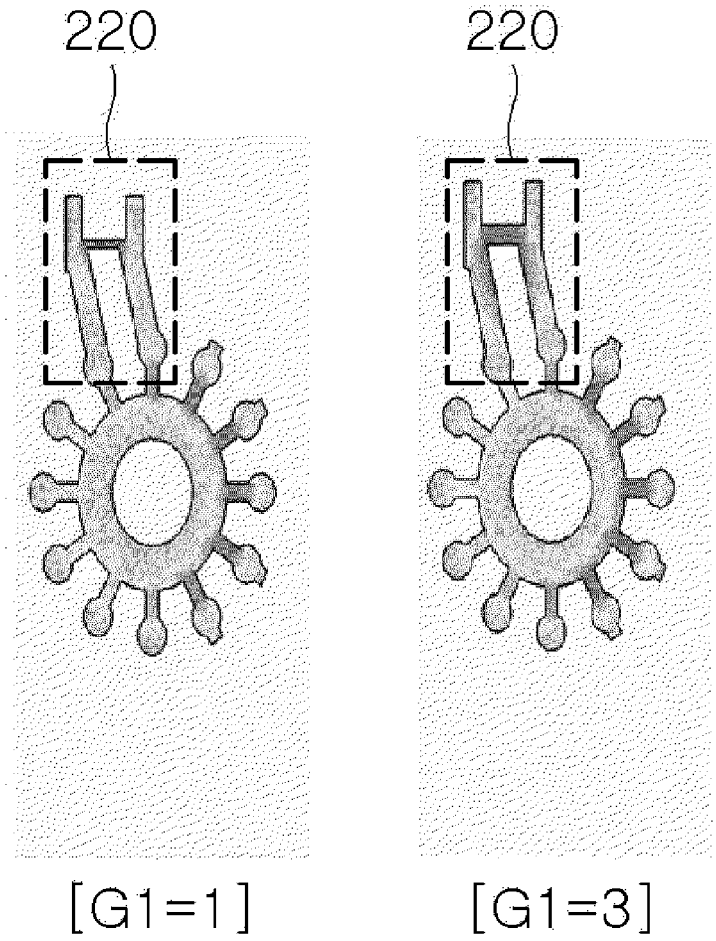
FIGS. 7A and 7B are diagrams illustrating a distribution of an electric field in a high-powered magnetron according to an embodiment of the present invention.
Figure 7B:
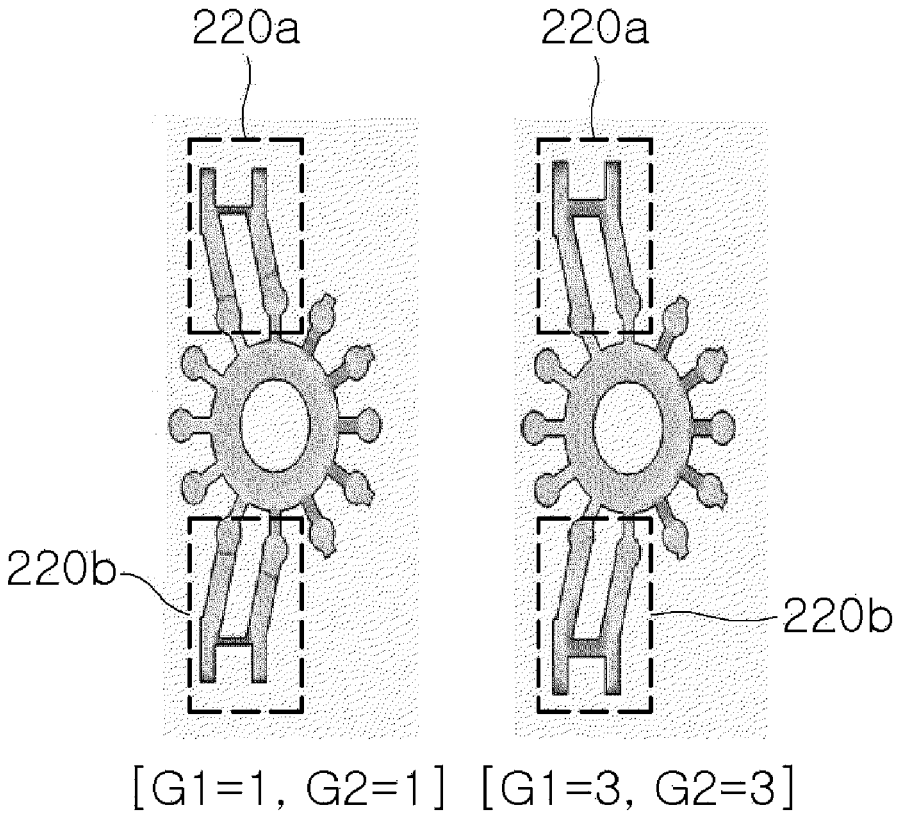

FIGS. 7A and 7B are diagrams illustrating a distribution of an electric field in a high-powered magnetron according to an embodiment of the present invention. As illustrated in the figure, it can be seen that the electric field distribution is changed through the number (FIG. 7A illustrated at a left side indicates one tuner and FIG. 7B illustrated at a right side indicates two tuners) of tuners and gap distance adjustment (G1, G2, and mm unit) of each tuner.

Further, as illustrated in FIGS. 7A and 7B, a particle accelerator according to an embodiment of the present invention is connected to the high-powered magnetron according to the above-described embodiment of the present invention, so that the particle accelerator may be configured to include a particle accelerating unit that accelerates the particles using the high-powered magnetron.

As described above, the high-powered magnetron according to an embodiment of the present invention starts electric field adjustment using the plurality of tuners to vary a wider range of frequency and configure a high-powered magnetron capable of adjusting the power. In this regard, the embodiments of the present invention have been described with reference to the accompanying drawings, but it can be understood by those skilled in the art that the present invention can be executed in other detailed forms without changing the technical spirit or requisite features of the present invention. As an example, a size and a length of the tuner gap are no limited to the above example, but the change in electric field using the tuner unit 220 may be modified and performed in various directions for achieving the object of the present invention. That is, the embodiments described above are not limitative and should be understood as being illustrative in all aspects.

The invention claimed is:

1. A high-powered magnetron comprising:

a diode including a cathode and an anode; and a tuner unit varying an electric field in the diode, wherein the tuner unit includes a plurality of tuners, wherein a frequency and power of the high-powered magnetron are determined by a gap between internal structures of at least one of the plurality of tuners, wherein at least one of the plurality of tuners adjust the gap between internal structures during an operation of the high-powered magnetron, and wherein a frequency variation range by the plurality of tuners is greater than a frequency variation range by a single tuner.

2. The high-powered magnetron of claim 1, wherein the tuner unit includes two tuners positioned symmetric to each other with respect to the diode.

3. The high-powered magnetron of claim 1, wherein the plurality of tuners includes a first tuner and a second tuner, a gap between internal structures of the first tuner being a first gap, and a gap between internal structures of the second tuner being a second gap, and wherein the frequency and the power of the high-powered magnetron are determined by adjusting the first gap while fixing the second gap.

4. The high-powered magnetron of claim 1, wherein the plurality of tuners includes a first tuner and a second tuner, a gap between internal structures of the first tuner being a first gap, and a gap between internal structures of the second tuner being a second gap, and wherein the frequency and the power of the high-powered magnetron are determined by adjusting the first gap and the second gap.

5. A particle accelerator comprising:

a high-powered magnetron of claim 1; and a particle accelerating unit connected with the high-powered magnetron to accelerate particles using the high-powered magnetron.

6. The high-powered magnetron of claim 1, wherein the frequency variation range of the high-powered magnetron including the plurality of tuners is greater than 10 MHz.

* * * * *